US009283760B2

(12) United States Patent
Hamade et al.

(10) Patent No.: US 9,283,760 B2
(45) Date of Patent: Mar. 15, 2016

(54) LIQUID DISCHARGE HEAD AND METHOD OF PRODUCING THE SAME

(71) Applicant: CANON KABUSHIKI KAISHA, Tokyo (JP)

(72) Inventors: Yohei Hamade, Tokyo (JP); Etsuko Sawada, Tokyo (JP); Satoshi Tsutsui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/476,497

(22) Filed: Sep. 3, 2014

(65) Prior Publication Data

US 2015/0062249 A1 Mar. 5, 2015

(30) Foreign Application Priority Data

Sep. 5, 2013 (JP) ..... 2013-183897

(51) Int. Cl.
*B41J 2/135* (2006.01)
*B41J 2/16* (2006.01)

(52) U.S. Cl.
CPC ..... *B41J 2/1631* (2013.01); *B41J 2/1603* (2013.01); *B41J 2/1626* (2013.01); *B41J 2/1634* (2013.01); *B41J 2/1639* (2013.01); *B41J 2/1645* (2013.01)

(58) Field of Classification Search
CPC ..... B41J 2/1606; B41J 2/164; B41J 2/1642; B41J 2/1643; B41J 2/1645; B41J 2/1646; B41J 2/1648; B41J 29/393; G01N 3/56
USPC ..... 347/19, 45
See application file for complete search history.

(56) References Cited

U.S. PATENT DOCUMENTS 6,123,863 A * 9/2000 Shimomura et al. ..... 216/27
6,402,301 B1 * 6/2002 Powers ..... B41J 2/1603 347/63
7,213,915 B2 * 5/2007 Tsutsumi et al. ..... 347/102
8,329,254 B2 * 12/2012 Matsushita ..... B41J 2/14209 427/384
8,911,061 B2 * 12/2014 Sawada ..... B41J 2/161 347/47
2005/0062801 A1 * 3/2005 Kato ..... B41J 2/1606 347/45

(Continued)

FOREIGN PATENT DOCUMENTS

JP 2005-145057 A 6/2005

OTHER PUBLICATIONS

CETRr, Comprehensive Materials Testing for Mechanical and Tribological Properties, available at http://www.cetr.com/eng/products/umt-2.html (last visited Jun. 12, 2015).*

*Primary Examiner* — Matthew Luu
*Assistant Examiner* — Patrick King
(74) *Attorney, Agent, or Firm* — Canon U.S.A. Inc., IP Division

(57) ABSTRACT

Provided is a liquid discharge head comprising a discharge port-forming member having discharge ports for discharging a liquid and having a surface provided with a liquid-repellent film. The liquid-repellent film includes a layer containing a resin composition containing at least one of polyurethane and polyrotaxane disposed on the discharge port-forming member and a layer containing a fluorine compound and having a thickness of 10 nm or less disposed on the resin composition-containing layer. When a scratch-forming tool, a diamond tip having a tip diameter of 15 μm, is pressed onto the liquid-repellent film with a load of 0.098 N (10 gf) and is reciprocated ten times, the depth of a scratch formed on the surface of the liquid-repellent film is smaller than the thickness of the fluorine compound-containing layer.

16 Claims, 6 Drawing Sheets

(56) References Cited

U.S. PATENT DOCUMENTS

2005/0172702 A1* 8/2005 Gitis ..... G01N 3/46
73/81

2008/0024560 A1* 1/2008 Ishizuka ..... B41J 2/14032
347/65

2010/0231631 A1* 9/2010 Hosaka ..... 347/15

* cited by examiner

LIQUID DISCHARGE HEAD AND METHOD OF PRODUCING THE SAME

BACKGROUND OF THE INVENTION

1. Field of the Invention

The present invention relates to a liquid discharge head and a method of producing the head.

2. Description of the Related Art

In order to obtain a satisfactory liquid discharge performance of a liquid discharge head, it is important to control the surface characteristics of a discharge port face. If a liquid remains near the discharge port, the flying direction of a liquid may deflect or the discharging speed of a liquid may decrease due to the load on the liquid to be discharged. As a method of discharging a liquid with high accuracy by solving these problems, for example, treatment of imparting water repellency to the periphery of the discharge port is known.

However, even if the periphery of the discharge port is water repellency-treated, in some cases, a liquid accumulates at the periphery of the discharge port by the mist of the liquid during discharge, and it is necessary to clean the discharge port face as required. The discharge port face is cleaned by, for example, scraping the discharge port face with a blade of an elastic member abutting on the discharge port face. In particular, in a case of using a resin-dispersed pigment ink as the liquid, the ink is apt to adhere to the discharge port face, and the discharge port face is required to be strongly scraped for removing the adhered liquid. However, in such a cleaning process, the discharge port face is worn by the friction between the blade and the discharge port face. Therefore, the discharge port face is required to have a high scratch resistance. In order to prevent the occurrence of such scratches, for example, Japanese Patent Laid-Open No. 2005-145057 describes a method of preventing a reduction in liquid repellency of the discharge port face by dispersing solid particles so as to protrude to the liquid-repellent surface to inhibit a cleaning tool from becoming into contact with the liquid-repellent molecules.

SUMMARY OF THE INVENTION

The liquid discharge head according to the present invention comprises a discharge port-forming member having discharge ports for discharging a liquid and having a surface provided with a liquid-repellent film, wherein the liquid-repellent film includes a resin composition-containing layer containing a resin composition containing at least one of polyurethane and polyrotaxane disposed on the discharge port-forming member and a layer containing a fluorine compound and having a thickness of 10 nm or less disposed on the resin composition-containing layer, wherein when a scratch-forming tool, a diamond tip having a tip diameter of 15 μm, is pressed onto the liquid-repellent film with a load of 0.098 N (10 gf) and is reciprocated ten times, the depth of a scratch formed on the surface of the liquid-repellent film is smaller than the thickness of the fluorine compound-containing layer.

The method of producing a liquid discharge head according to the present invention produces a discharge port-forming member having discharge ports for discharging a liquid and having a surface provided with a liquid-repellent film. The method comprises:

forming a coating layer on a substrate;

forming a liquid-repellent film by laminating a resin composition-containing layer containing a resin composition containing at least one of polyurethane and polyrotaxane and a layer containing a fluorine compound in this order on the coating layer; and forming a discharge port in the coating layer and the liquid-repellent film.

Further features of the present invention will become apparent from the following description of exemplary embodiments with reference to the attached drawings.

DESCRIPTION OF THE EMBODIMENTS

In the method described in Japanese Patent Laid-Open No. 2005-145057, if the discharge port face is scratched once by abrasion due to the use for a long time, the scratch does not disappear to reduce the printing performance when it is used as an ink jet recording head.

It is an object of the present invention to provide a liquid discharge head including a discharge port-forming member of which the surface has excellent abrasion resistance and having high liquid repellency.

[Liquid Discharge Head]

The liquid discharge head according to the present invention includes a discharge port-forming member having discharge ports for discharging a liquid and having a surface provided with a liquid-repellent film. The liquid-repellent film includes a resin composition-containing layer containing a resin composition containing at least one of polyurethane and polyrotaxane disposed on the discharge port-forming member and a layer containing a fluorine compound and having a thickness of 10 nm or less disposed on the resin composition-containing layer. When a scratch-forming tool, a diamond tip having a tip diameter of 15 μm, is pressed onto the liquid-repellent film with a load of 0.098 N (10 gf) and is reciprocated ten times, the depth of a scratch formed on the surface of the liquid-repellent film is smaller than the thickness of the fluorine compound-containing layer.

The liquid-repellent film of the liquid discharge head according to the present invention includes a resin composition-containing layer containing a resin composition containing at least one of polyurethane and polyrotaxane (hereinafter, referred to as self-repairing layer) and a layer containing a fluorine compound (hereinafter, referred to as liquid-repellent layer). The self-repairing layer containing at least one of polyurethane and polyrotaxane has high flexibility. Therefore, even if a scratch is formed on the surface of the liquid-repellent film, the scratch can be repaired to improve the abrasion resistance. The liquid-repellent layer containing a fluorine compound has high liquid repellency. The thickness of the liquid-repellent layer is 10 nm or less, which allows the self-repairing layer disposed under the liquid-repellent layer to fully use the self-reparability to improve the abrasion resistance. In addition, when the liquid-repellent film is subjected to the abrasion test described above, the depth of the scratch formed on the surface of the liquid-repellent film is smaller than the thickness of the liquid-repellent layer. Therefore, the scratch does not reach the self-repairing layer. Consequently, the self-repairing layer can maintain the self-repairability, and the liquid-repellent layer can have high liquid repellency. As a result, in the present invention, the liquid discharge head can prolong its lifetime.

Figure 1:
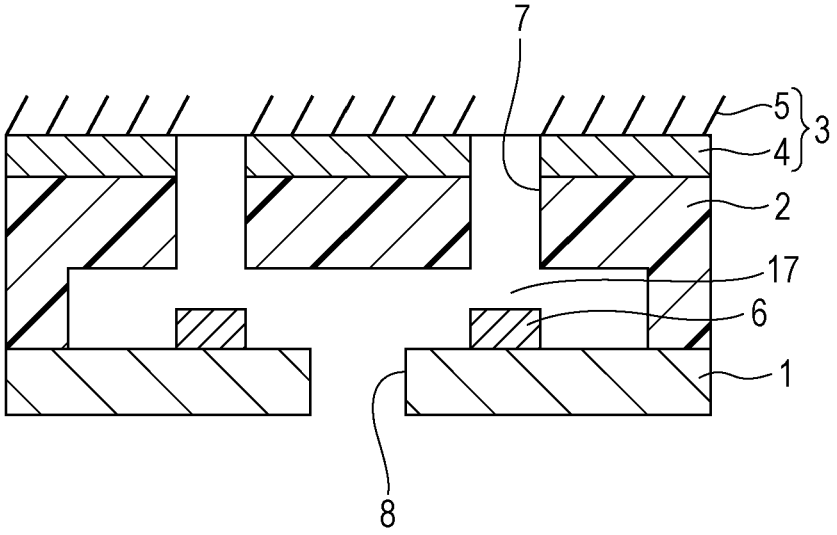
FIG. 1 is a cross-sectional view of an example of the liquid discharge head according to the present invention.
Figure 3:
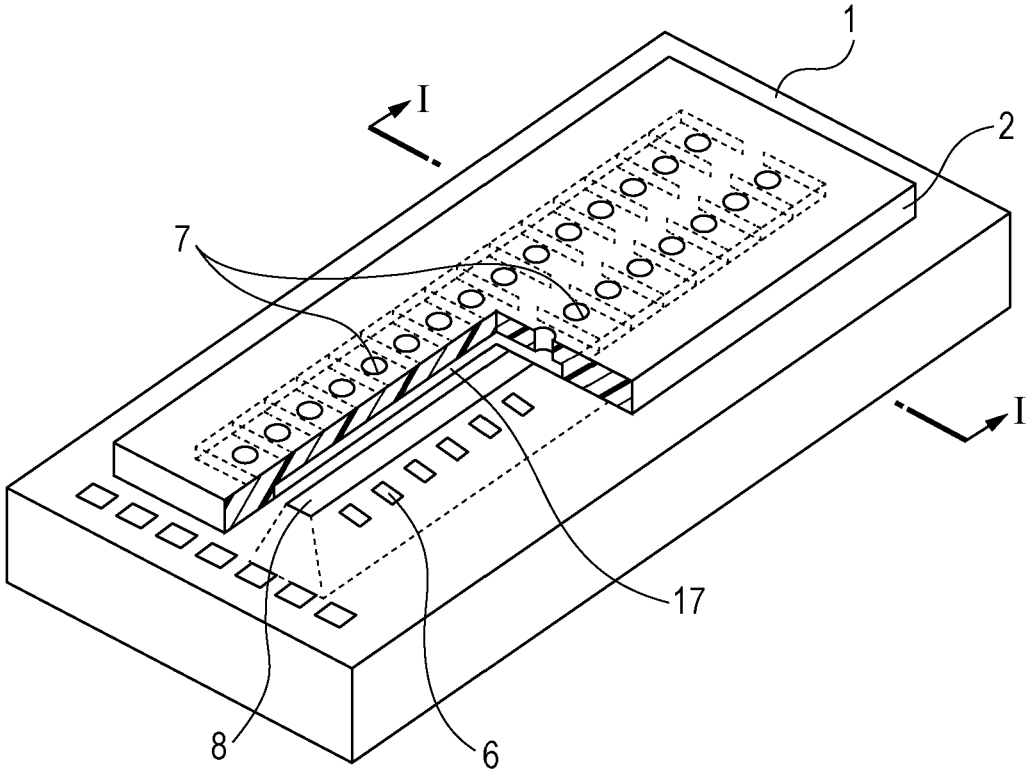
FIG. 3 is a perspective view of an example of the liquid discharge head according to the present invention.

FIGS. 1 and 3 show an example of the liquid discharge head according to the present invention. FIG. 1 is a cross-sectional view of the liquid discharge head shown in FIG. 3 taken from the line I-I of FIG. 3. The liquid discharge head includes a discharge port-forming member 2 provided with discharge ports 7 from which a liquid is discharged on a substrate 1 provided with a plurality of energy-generating element 6 for discharging the liquid. A liquid-repellent film 3 including a self-repairing layer 4 and a liquid-repellent layer 5 is disposed on the discharge port-forming member 2. The substrate 1 is provided with a supply port 8 for supplying a liquid to a channel 17.

The liquid discharge head according to the present invention can be used as, for example, an ink jet recording head that discharges an ink.

(Self-Repairing Layer)

The self-repairing layer according to the present invention contains a resin composition containing at least one of polyurethane and polyrotaxane. The resin composition has high flexibility and thereby has high self-repairability. The dent scratch formed during the cleaning of the discharge port is repaired to inhibit the degradation of the liquid-repellent film. The resin composition can contain a resin having a group reactive with the liquid-repellent layer. In the present invention, the term "self-repairability" refers to a property that a scratch formed on a liquid-repellency film by pressing a scratch-forming tool, a diamond tip having a tip diameter of 15 μm, onto the liquid-repellent film with a load of 0.098 N (10 gf) disappears with time.

The polyurethane can be prepared by reacting one equivalent of a diisocyanate compound with a raw material containing more than one equivalent of a di- or higher valent polyol. The use of a di- or higher valent polyol in an amount of larger than one equivalent enhances the reactivity with the liquid-repellent layer to improve the solvent resistance of the liquid-repellent film.

Examples of the diisocyanate include aromatic diisocyanates, aliphatic diisocyanates, and alicyclic diisocyanates. In particular, from the viewpoint of preventing yellowing by ultraviolet rays, the diisocyanates can be an aliphatic diisocyanate or an alicyclic diisocyanate. Examples of the diisocyanate include hexamethylene diisocyanate, dicyclohexylmethane diisocyanate, and 2,4,4-trimethylhexamethylene diisocyanate. These diisocyanates may be used alone or in combination.

Examples of the polyol include polyether polyols, polyester polyols, and polycarbonate polyols. From the viewpoint of the balance of durability, cost, and mechanical strength, the polyol can be a polyester polyol. Commercially available examples of the polyol include POLILIGHT (trade name, manufactured by DIC Corporation) and MAXIMOL (trade name, manufactured by Kawasaki Kasei Chemicals Ltd.). These polyols may be used alone or in combination.

The content of the polyurethane in the resin composition constituting the self-repairing layer is 30% by mass or more, more preferably 40% by mass or more, based on the total mass of the resin composition, from the viewpoint of the reactivity with the liquid-repellent layer and the self-repairability. The upper limit of the content is not limited and can be 95% by mass or less.

The raw material of the polyurethane can further contain a chain extender, from the viewpoint of imparting higher flexibility to the self-repairing layer. The chain extender can be a short chain diol or a tri- or higher valent short chain polyol. The short chain diol is a diol having 2 to 4 carbon atoms, and examples thereof include 1,4-butane diol. The short chain polyol is a polyol having 2 to 4 carbon atoms, and examples of the tri- or higher valent short chain polyol include 1,2,4-butane triol. These chain extenders may be used alone or in combination.

The polyurethane may have any mass-average molecular weight, which can be, for example, 10000 or more and 1000000 or less. The mass-average molecular weight can be measured by gel permeation chromatography (GPC).

Figure 2:
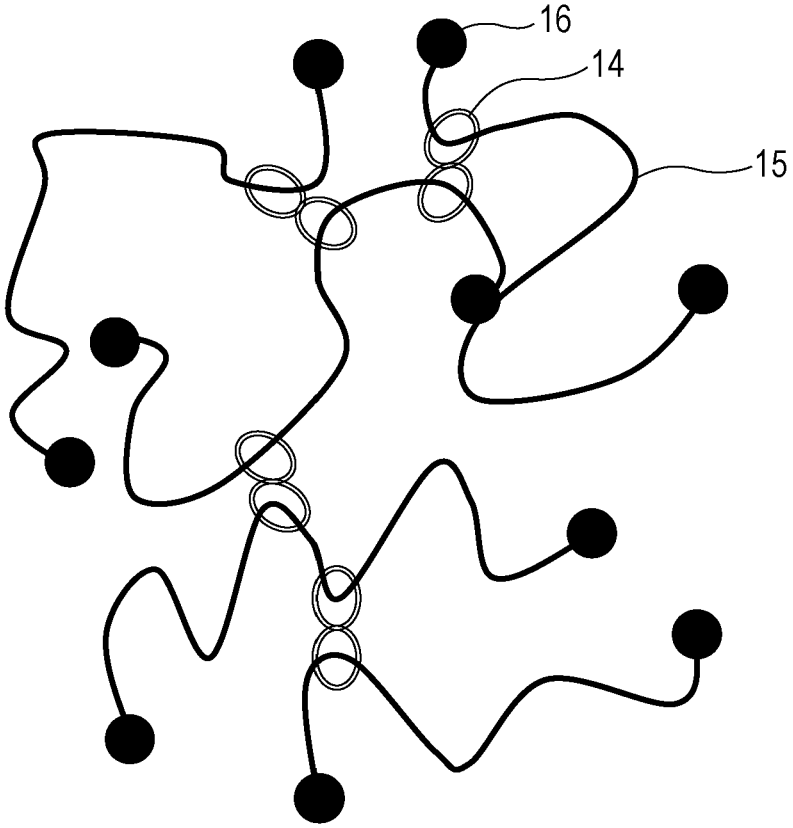
FIG. 2 is a diagram schematically illustrating an example of polyrotaxane used in the present invention.

In the present invention, as shown in FIG. 2, the polyrotaxane includes a circular molecule 14, a linear molecule 15 passing through the circular molecule 14 in a skewered state, and blocking groups 16 disposed at both ends of the linear molecule 15 for preventing detachment of the circular molecule 14.

The circular molecule 14 can include a reactive group. The circular molecules 14 having reactive groups can bind to each other and also can readily react with the liquid-repellent layer. Examples of the reactive group include hydroxyl, amino, carboxyl, and thiol groups. In particular, from the viewpoint of the reactivity with the liquid-repellent layer, the reactive group can be a hydroxyl group. The number of the reactive group possessed by the circular molecule 14 may be one or two or more. Examples of the circular molecule 14 include cyclodextrin, crown ethers, benzo crowns, dibenzo crowns, dicyclohexano crowns, and derivatives or modifications thereof. Examples of the cyclodextrin include α-cyclodextrin, β-cyclodextrin, and γ-cyclodextrin. These circular molecules 14 may be used alone or in combination.

The linear molecule 15 can have reactive groups on both ends. The linear molecule 15 having reactive groups on both ends can readily react with the blocking groups 16 and the liquid-repellent layer. Examples of the reactive group include hydroxyl, amino, carboxyl, and thiol groups. In particular, from the viewpoint of the reactivity with the liquid-repellent layer, the reactive group can be a hydroxyl group. The number of the reactive group possessed by the linear molecule 15 may be one or two or more. Examples of the linear molecule 15 include polyethylene glycol and polypropylene glycol. These linear molecules 15 may be used alone or in combination.

The blocking groups 16 are disposed on both ends of the linear molecule 15 and may be any group that can maintain the state of the linear molecule 15 passing through the void portion of the circular molecule 14 in a skewered state. Examples of the blocking group 16 include a trityl group, dinitrophenyl groups such as 2,4-dinitrophenyl and 3,5-dinitrophenyl groups, and an adamantane group. These blocking groups 16 may be the same groups or two or more different groups.

The content of the polyrotaxane in the resin composition constituting the self-repairing layer is 30% by mass or more, more preferably 40% by mass or more, based on the total mass of the resin composition, from the viewpoint of the reactivity with the liquid-repellent layer and the self-repairability. The upper limit of the content is not limited and can be 95% by mass or less.

The discharge port-forming member of the liquid discharge head can be processed by, for example, laser irradiation or photolithography using a photosensitive resin. In particular, from the viewpoint of arraying discharge ports at a high density, processing by photolithography can be employed. In order to perform the processing by photolithography, the resin composition constituting the self-repairing layer 4 can contain a photo-curable resin. The photo-curable resin can be a photocationic-curable resin. The photocationic-curable resin can be an epoxy resin, which has high mechanical strength and can tightly adhere to a base material.

Examples of the epoxy resin include bisphenol A epoxy resins and novolac epoxy resins. Examples of commercially available epoxy resin include SU8 (trade name, manufactured by Nippon Kayaku Co., Ltd.) and EHPE3150 (trade name, manufactured by Daicel Corporation). These resins may be used alone or in combination. The epoxy resin preferably has an epoxy equivalent of 2000 or less, more preferably 1000 or less, and most preferably 800 or less. An epoxy equivalent of 2000 or less can prevent a reduction in crosslink density during the curing of the epoxy resin and can prevent a reduction in glass transition temperature of the cured epoxy resin and also prevent a reduction in adhesion. The epoxy equivalent is a value defined as the molecular weight of an epoxy resin per one epoxy group.

In addition, when the resin composition constituting the self-repairing layer contains an epoxy resin, the epoxy resin can be in a solid form at normal temperature from the viewpoint of preventing a reduction in resolution due to high fluidity of a coating film. The normal temperature in the present invention refers to a temperature range of 20° C.±15° C., i.e., 5° C. or more and 35° C. or less, as specified in the Japanese Industrial Standards (JIS Z 8703). A material that is in a solid form at normal temperature has a melting point of higher than 35° C.

When the resin composition constituting the self-repairing layer contains a photocationic-curable resin, the resin composition can contain a photocationic polymerization initiator for curing the photocationic-curable resin. Examples of the photocationic polymerization initiator include aromatic iodonium salts and aromatic sulfonium salts. Commercially available examples of the aromatic iodonium salt include DPI-105, MPI-103, and MPI-105 (trade names, manufactured by Midori Kagaku Co., Ltd.). Commercially available examples of the aromatic sulfonium salt include Adeka Optomer SP-170 and SP-172 (trade names, manufactured by ADEKA Corporation). These initiators may be used alone or in combination. The cationic polymerization can be further enhanced by using a reducing agent together with the photocationic polymerization initiator and performing the polymerization under heating. The reducing agent can be copper triflate from the viewpoint of reactivity and solubility into a photocationic-curable resin.

(Liquid-Repellent Layer)

The liquid-repellent layer according to the present invention contains a fluorine compound. The fluorine compound can have a perfluoroalkyl group or a perfluoropolyether group, from the viewpoint of high liquid repellency. Examples of the perfluoroalkyl group include groups represented by Formula (1):

$$F-(CF_2)_k- \qquad \text{Formula (1)}$$

wherein, k represents an integer of 3 or more.

Examples of the perfluoropolyether group include groups represented by Formula (2):

$$-(CF_2CF_2CF_2O)_p-(CF_2CF_2O)_q-\left(\underset{\underset{CF_3}{|}}{CF}-CF_2-O\right)_r-(CF_2O)_s- \qquad \text{Formula (2)}$$

wherein, p, q, r, and s each independently represent an integer of 0 or more, provided that at least one of p, q, r, and s represents an integer of 1 or more.

In Formula (1), a larger k provides higher liquid repellency, and k is preferably 4 or more and more preferably 5 or more. However, from the viewpoint of solubility in a solvent, k should be an integer of 10 or less. In Formula (2), larger p, q, r, and s provide higher liquid repellency, and p, q, r, and s are each preferably 2 or more and more preferably 3 or more. However, from the viewpoint of solubility in a solvent, p, q, r, and s should be each an integer of 30 or less.

The perfluoropolyether group moiety preferably has an average molecular weight of 500 to 20000, more preferably 1000 to 10000, and most preferably 2000 to 8000. When the average molecular weight is 500 or more, sufficient liquid repellency can be provided, whereas when the average molecular weight is 20000 or less, sufficient solubility to a solvent is obtained. In Formula (2), the average molecular weight of a perfluoropolyether group moiety is the sum of the molecular weights of the moieties represented by the repeating units. The average molecular weight of the perfluoropolyether group moiety is measured by gel permeation chromatography (GPC).

The liquid-repellent layer is required to have high mechanical strength and low solubility to a liquid. Accordingly, the fluorine compound can have an inorganic reactive group. The inorganic reactive group can be a reactive silane group from the viewpoint of versatility. Examples of the fluorine compound having a reactive silane group include compounds presented by Formula (3), (4), (5), or (6). These compounds may be used alone or in combination.

$$F\text{-}Rp\text{-}X-SiR_aY_{3-a} \qquad \text{Formula (3)}$$

wherein, Rp represents a perfluoropolyether group; X represents a divalent organic group; R represents a hydrolytic substituent; Y represents a non-hydrolytic substituent; and a represents an integer of 1 to 3, $$Y_{3-a}R_aSi\text{-}A\text{-}Rp\text{-}A\text{-}SiR_aY_{3-a} \qquad \text{Formula (4)}$$

wherein, A represents an organic group having 1 to 12 carbon atoms; and Rp, R, Y, and a are synonymous with those in Formula (3), $$F-Rp-Q^1-\left(\underset{\underset{SiR_aY_{3-a}}{|}}{A}\right)_m-Z \qquad \text{Formula (5)}$$

wherein, Z represents a hydrogen atom or an alkyl group; $Q^1$ represents a divalent bonding group; m represents an integer of 1 or more; Rp, R, Y, and a are synonymous with those in Formula (3); and A is synonymous with that in Formula (4), and $$F\text{-}Rp\text{-}Q^2\text{-}(\text{-}A\text{-}SiR_aY_{3-a})_n \qquad \text{Formula (6)}$$

wherein, n represents an integer of 1 or 2; $Q^2$ represents a divalent bonding group when n is 1 and represents a trivalent bonding group when n is 2; Rp, R, Y, and a are synonymous with those in Formula (3); and A is synonymous with that in Formula (4).

In Formulae (3) to (6), Rp can be the perfluoropolyether group described above; X can be an alkylene group such as a methylene group, an ethylene group, or a propylene group; R can be, for example, a halogen atom, an alkoxy group, an amino group, or a hydrogen atom, in particular, from the viewpoint of high versatility, R can be an alkoxy group such as a methoxy group or an ethoxy group; Y can be, for example, an alkyl group such as a methyl group or an ethyl group; A can be, for example, a methylene group, an ethylene group, or a propylene group; the alkyl group represented by Z can be, for example, a methyl group, an ethyl group, or a propyl group; $Q^1$ and $Q^2$ are each, for example, a carbon atom or a nitrogen atom; a can be 2 or 3; and m can be an integer of 1 to 3.

Examples of the fluorine compound include compounds represented by any of Formulae (7) to (11). These compounds may be used alone or in combination.

$$F-(CF_2)_t-Si(OCH_3)_3 \qquad \text{Formula (7)}$$

wherein, t represents an integer of 3 or more,

Formula (8)

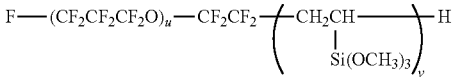

wherein, u represents an integer of 3 to 60; and v represents an integer of 1 to 3, $$F-(CF_2CF_2CF_2O)_w-CF_2CF_2-CH_2O(CH_2)_3-Si(OCH_3)_3 \qquad \text{Formula (9)}$$

wherein, w represents an integer of 3 to 60, $$(H_3CO)_3Si-CH_2CH_2CH_2-OCH_2CF_2-(OCF_2CF_2)_x-O(CF_2)_y-OCF_2CH_2O-CH_2CH_2CH_2-Si(OCH_3)_3 \qquad \text{Formula (10)}$$

wherein, x represents an integer of 20 or less; and y represents an integer of 30 or less, and Formula (11)

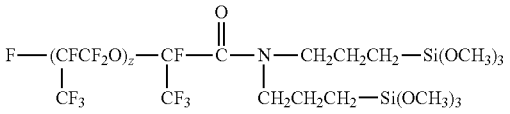

wherein, z represents an integer of 3 to 60.

In Formula (7), t can be an integer of 4 or more and 20 or less. In Formula (8), u can be an integer of 15 or more and 45 or less; v can be an integer of 2 or 3. In Formula (9), w can be an integer of 3 or more and 10 or less. In Formula (10), x can be an integer of 3 or more and 10 or less; and y can be an integer of 3 or more and 10 or less. In Formula (11), z can be an integer of 3 or more and 10 or less.

(Thickness of Liquid-Repellent Layer)

In the present invention, from the viewpoint of fully using the self-repairability of the self-repairing layer and improving the abrasion resistance, the liquid-repellent layer can have a thickness of 10 nm or less. A thickness of 10 nm or less of the liquid-repellent layer allows patterning of the liquid-repellent layer together with the self-repairing layer and the coating layer. The thickness of the liquid-repellent layer is preferably 8 nm or less, more preferably 6 nm or less, and most preferably 5 nm or less and can be, for example, 1 nm or more.

(Abrasion Test)

In the present invention, when a scratch-forming tool, a diamond tip having a tip diameter of 15 μm, is pressed onto the liquid-repellent film with a load of 0.098 N (10 gf) and is reciprocated ten times, the depth of a scratch formed on the surface of the liquid-repellent film is smaller than the thickness of the liquid-repellent layer. In the abrasion test for the liquid-repellent film, the depth of the scratch formed on the surface of the liquid-repellent film is smaller than the thickness of the liquid-repellent layer. Therefore, the scratch does not reach the self-repairing layer. Consequently, the self-repairing layer can maintain the self-repairability, and the liquid-repellent layer can have high liquid repellency. The depth of a scratch is preferably 80% or less, more preferably 60% or less, and most preferably 50% or less of the thickness of the liquid-repellent layer. If no scratch is formed on the surface of the liquid-repellent film in the abrasion test, the depth of the scratch is defined as 0 (zero). The depth of a scratch was measured with a laser microscope.

[Method of Producing Liquid Discharge Head]

The method of producing a liquid discharge head according to the present invention produces a liquid discharge head having a discharge port-forming member having discharge ports for discharging a liquid and having a surface provided with a liquid-repellent film. The method includes the steps of forming a coating layer on a substrate, forming a liquid-repellent film by laminating a resin composition-containing layer containing a resin composition containing at least one of polyurethane and polyrotaxane and a layer containing a fluorine compound in this order on the coating layer, and forming a discharge port in the coating layer and the liquid-repellent film.

The method according to the present invention can produce a liquid discharge head according to the present invention with high accuracy and high efficiency. An example of the method producing a liquid discharge head according to the present invention is shown in FIGS. 4A to 4G. FIGS. 4A to 4G are process cross-sectional views of a liquid discharge head corresponding to that shown in FIG. 3, taken from the line I-I of FIG. 3.

Figure 4A:
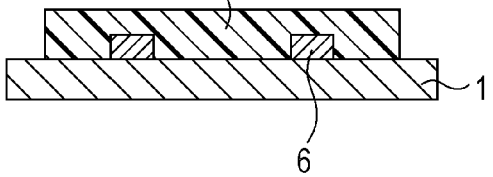
FIGS. 4A to 4G are cross-sectional views illustrating an example of the method of producing a liquid discharge head according to the present invention.

A mold material 9 for a channel is first formed on a substrate 1 provided with an energy-generating element 6 that generates energy for discharging a liquid (FIG. 4A). Since the mold material 9 is dissolved and removed later, the mold material 9 can be a positive photosensitive resin composition. Examples of the positive photosensitive resin composition include resin compositions containing vinyl ketone photodegradation polymers such as polymethyl isopropenyl ketone and polyvinyl ketone.

Figure 4B:
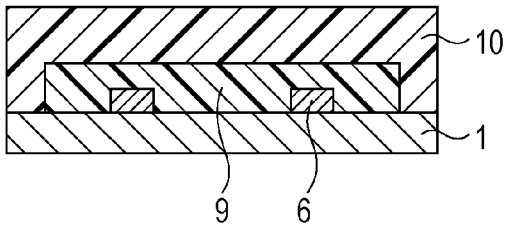

A coating layer 10, which is formed into a discharge port-forming member, is then formed on the mold material 9 (FIG. 4B). The coating layer 10 can be formed by applying a material for the coating layer 10 by a method such as spin coating, slit coating, or roll coating.

The material for the coating layer 10 can be a photo-curable resin composition or a thermosetting resin composition. The photo-curable resin composition can be a photocationic-curable resin composition. The coating layer 10 is required to have high mechanical strength and to tightly adhere to a base material. Therefore, the photo-curable resin composition can particularly be a photocationic-curable resin composition containing an epoxy resin. The content of the epoxy resin in the photocationic-curable resin composition can be 20% by mass or more. A content of 20% by mass or more can control the thickness of the coating layer 10 to be suitable for forming discharge ports.

The epoxy resin is, for example, a bisphenol A epoxy resin or a novolac epoxy resin. Commercially available examples of the epoxy resin include SU8 (trade name, manufactured by Nippon Kayaku Co., Ltd.) and EHPE3150 (trade name, manufactured by Daicel Corporation). These resins may be used alone or in combination. The epoxy resin preferably has an epoxy equivalent of 2000 or less, more preferably 1000 or less, and most preferably 800 or less. An epoxy equivalent of 2000 or less can prevent a reduction in crosslink density during the curing of the epoxy resin and can prevent a reduction in glass transition temperature of the cured epoxy resin and also prevent a reduction in adhesion. In addition, when the photocationic-curable resin composition contains an epoxy resin, the epoxy resin can be one that in a solid form at normal temperature from the viewpoint of preventing a reduction in resolution due to high fluidity of the resulting coating film.

The photocationic-curable resin composition can contain a photocationic polymerization initiator for curing the photocationic-curable resin. Examples of the photocationic polymerization initiator include aromatic iodonium salts and aromatic sulfonium salts. Commercially available examples of the aromatic iodonium salt include DPI-105, MPI-103, and MPI-105 (trade names, manufactured by Midori Kagaku Co., Ltd.). Commercially available examples of the aromatic sulfonium salt include Adeka Optomer SP-170 and SP-172 (trade names, manufactured by ADEKA Corporation). These resins may be used alone or in combination. The cationic polymerization can be further enhanced by using a reducing agent together with the photocationic polymerization initiator and performing the polymerization under heating. The reducing agent can be copper triflate from the viewpoint of reactivity and solubility into a photocationic-curable resin.

Figure 4C:
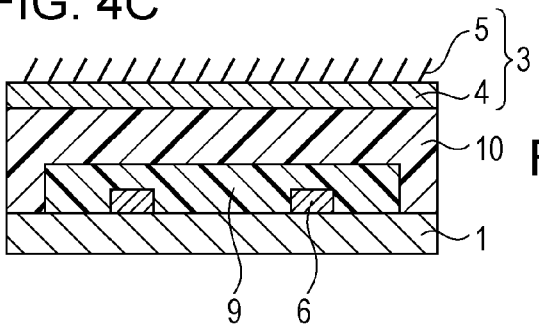

A self-repairing layer 4 and a liquid-repellent layer 5 are then formed in this order on the coating layer 10 for imparting liquid repellency and abrasion resistance to the surface of the discharge port-forming member (FIG. 4C). The self-repairing layer 4 and the liquid-repellent layer 5 can be made of a material described above. The self-repairing layer 4 and the liquid-repellent layer 5 can be formed by applying the respective materials for the layers by a method such as spin coating, slit coating, or roll coating. From the viewpoint of preventing a reduction in the function of the self-repairing layer 4, the thickness of the liquid-repellent layer 5 is preferably 10 nm or less, more preferably 8 nm or less, more preferably 6 nm or less, and most preferably 5 nm or less and can be, for example, 1 nm or more.

Figure 4D:
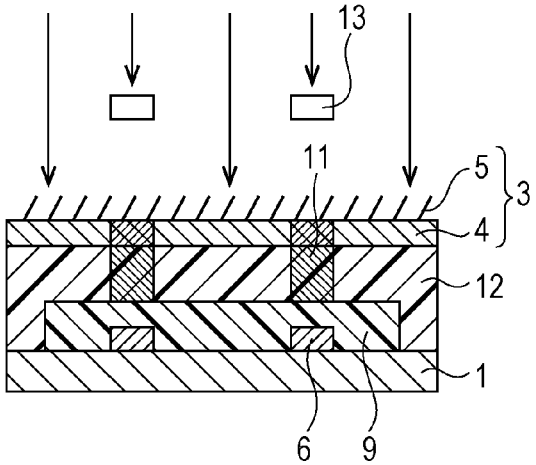

Latent images of discharge ports are then formed by exposing the coating layer 10 to light through a photomask 13 such that non-exposure portions 11 coincide with the positions of the discharge ports (FIG. 4D). On this occasion, the liquid-repellent layer 5 can be patterned together with the self-repairing layer 4 and the coating layer 10. Although the fluorine compound contained in the liquid-repellent layer 5 is not photosensitive, the liquid-repellent layer 5 can be patterned together with the self-repairing layer 4 by reacting with the self-repairing layer 4. The patterning can be satisfactorily achieved by controlling the thickness of the liquid-repellent layer 5 to 10 nm or less. The discharge ports may also be formed by using a thermosetting resin composition as the material for the coating layer 10 and ablating the liquid-repellent film 3 and the coating layer 10 with short-pulse laser light condensed with a lens.

Figure 4E:
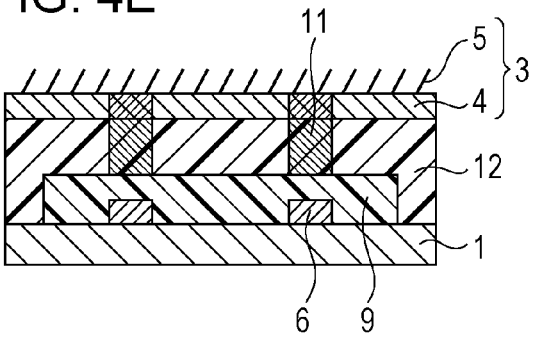
Figure 4F:
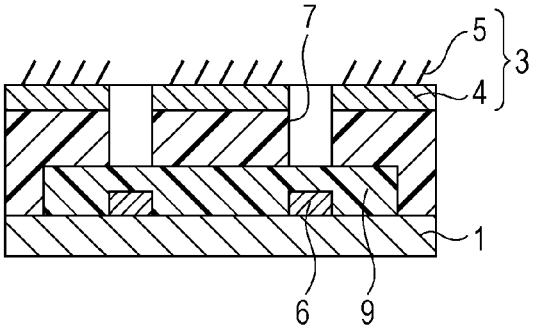
Figure 4G:
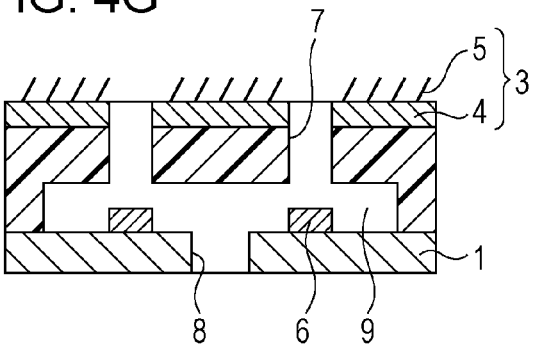

Subsequently, crosslinking is caused in the exposure portion 12 by baking (FIG. 4E). Then, developing is performed using a solvent that does not dissolve the exposure portions 12 of the coating layer 10, the self-repairing layer 4, and the liquid-repellent layer 5, but dissolve the non-exposure portions 11 (FIG. 4F). A supply port 8 is further formed on the rear face of the substrate 1 by, for example, anisotropic etching, and the mold material 9 is dissolved and removed using a solvent that can dissolve the mold material 9 (FIG. 4G). Lastly, the coating layer 10 and the liquid-repellent film 3 are completely cured by cure acceleration by, for example, light or heat. As a result, a liquid discharge head according to the present invention can be produced.

EXAMPLES

Non-limiting exemplary embodiments of the present invention will now be described in detail.

Example 1

Preparation of Resin Composition A

Polyurethane (E) synthesized from the raw materials shown in Table 5, an epoxy resin, a photocationic polymerization initiator, and a solvent were mixed at a mixing ratio shown in Table 1 to prepare resin composition A to be used for forming a self-repairing layer.

TABLE 1

| | | |
|---|---|---|
| Polyurethane (E) | | 50 parts by mass |
| Epoxy resin | trade name: EHPE-3150, manufactured by Daicel Corp. | 50 parts by mass |
| Photocationic polymerization initiator | trade name: SP-172, manufactured by ADEKA Corp. | 3 parts by mass |
| Solvent | methyl ethyl ketone, special grade chemical | 100 parts by mass |

(Production of Liquid Discharge Head)

A liquid discharge head was produced by the method shown in FIGS. 4A to 4G. Polymethyl isopropenyl ketone (trade name: ODUR-1010, manufactured by Tokyo Ohka Kogyo Co., Ltd.) was applied at a thickness of 14 μm onto a silicon substrate 1 provided with energy-generating elements 6 and was heated at 120° C. for 6 minutes. Subsequently, exposure to light in the pattern of mold material with an exposure apparatus (product name: UX3000, manufactured by Ushio Inc.) and developing with methyl isobutyl ketone (MIBK) (FIG. 4A) were performed to form a mold material 9 (FIG. 4A). The photocationic-curable resin composition prepared by mixing the materials shown in Table 2 was then applied at a thickness of 25 μm onto the mold material 9 and was heated at 60° C. for 9 minutes to form a coating layer 10 (FIG. 4B).

TABLE 2

| | | |
|---|---|---|
| Epoxy resin | trade name: EHPE-3150, manufactured by Daicel Corp. | 100 parts by mass |
| Additive | 1,4-HFAB, manufactured by Central Glass Co., Ltd. | 20 parts by mass |
| Photocationic polymerization initiator | trade name: SP-172, manufactured by ADEKA Corp. | 6 parts by mass |
| Silane coupling agent | trade name: A-187, manufactured by Momentive Performance Materials Inc. | 5 parts by mass |

TABLE 2-continued

| | | |
|---|---|---|
| Solvent | xylene, manufactured by Kishida Chemical Co., Ltd. | 70 parts by mass |

In Table 2, 1,4-HFAB refers to 1,4-bis(hexafluoro-α-hydroxyisopropyl)benzene.

Subsequently, as shown in FIG. 4C, a self-repairing layer 4 and a liquid-repellent layer 5 were formed in this order on the coating layer 10. The self-repairing layer 4 was formed by applying the resin composition A at the thickness shown in Table 6 onto the coating layer 10 and performing heat treatment at 70° C. for 3 minutes. The liquid-repellent layer 5 was formed by applying the material shown in Table 6 at the thickness shown in Table 6 onto the self-repairing layer 4 and performing heat treatment at 70° C. for 3 minutes.

Subsequently, as shown in FIG. 4D, exposure to radiation energy was performed at an exposure dose of 350 mJ/cm$^2$ with an i-ray exposure stepper (manufactured by CANON KABUSHIKI KAISHA) through a photomask 13 such that discharge port-forming portions coincide with non-exposure portions 11, followed by heat treatment at 90° C. for 4 minutes (FIG. 4E). Subsequently, as shown in FIG. 4F, discharge ports 7 were formed by developing with a liquid mixture of xylene/MIBK=6/4 (mass ratio).

A mask for forming a supply port was appropriately disposed on the rear face of the substrate 1, and the front face of the substrate 1 was protected with a rubber film. Then, s supply port 8 was formed in the substrate 1 by anisotropic etching. The rubber film was removed, and the mold material 9 was decomposed by irradiating the entire surface of the substrate 1 with ultraviolet light using an exposure apparatus (product name: UX3000, manufactured by Ushio Inc.). The mold material 9 was then dissolved and removed with methyl lactate (FIG. 4G). The coating layer 10 and the liquid-repellent film 3 were completely cured by heat treatment at 200° C. for 1 hour. Subsequently, electrical connection and appropriate arrangement of a tank and other components were performed to produce a liquid discharge head.

(Production of Sample for Evaluating Scratch)

The surface of the liquid-repellent film of the liquid discharge head is provided with fine patterns such as discharge ports, and it is therefore difficult to distinguish the patterns from scratches formed by an abrasion test. Accordingly, a sample for evaluating scratches was separately produced by the method shown in FIGS. 5A to 5D.

Figure 5A:
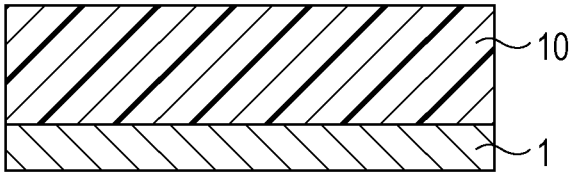
FIGS. 5A to 5D are cross-sectional views illustrating a method of producing a sample for evaluating scratches according to the present invention.

As shown in FIG. 5A, a photocationic-curable resin composition prepared by mixing the materials shown in Table 2 was applied at a thickness of 25 μm onto a silicon substrate 1 and was heated at 60° C. for 9 minutes to form a coating layer 10.

Figure 5B:
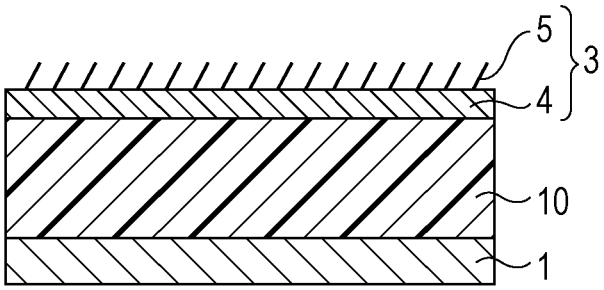

Subsequently, as shown in FIG. 5B, a self-repairing layer 4 and a liquid-repellent layer 5 were formed in this order on the coating layer 10. The self-repairing layer 4 was formed by applying the resin composition A at the thickness shown in Table 6 onto the coating layer 10 and performing heat treatment at 70° C. for 3 minutes. The liquid-repellent layer 5 was formed by applying the material shown in Table 6 at the thickness shown in Table 6 onto the self-repairing layer 4 and performing heat treatment at 70° C. for 3 minutes.

Figure 5C:
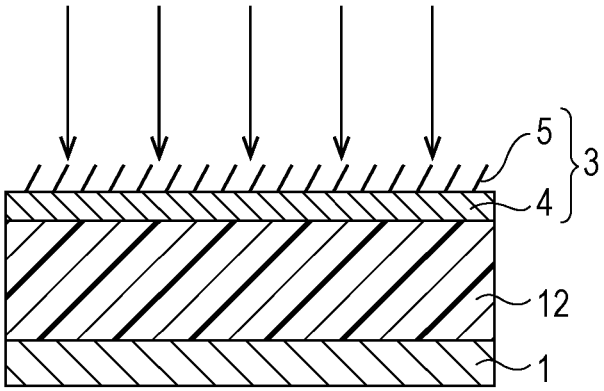
Figure 5D:
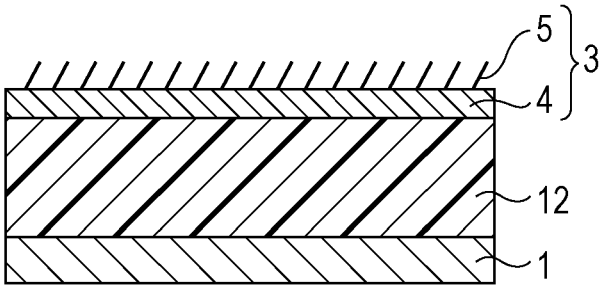

Subsequently, as shown in FIG. 5C, exposure to radiation energy was performed at an exposure dose of 350 mJ/cm$^2$ with an i-ray exposure stepper (manufactured by CANON KABUSHIKI KAISHA) through a blank mask, followed by heat treatment at 90° C. for 4 minutes (FIG. 5D). Then, the coating layer 10 and the liquid-repellent film 3 were completely cured by heat treatment at 200° C. for 1 hour to produce a sample for evaluating scratches.

(Evaluation)

The resulting liquid discharge heads were subjected to an abrasion test, and the dynamic contact angle for pure water and the printing property were evaluated. The resulting sample for evaluating scratches was subjected to an abrasion test, and whether a scratch was formed or not was observed by a scanning electron microscopic (SEM) photograph. If a scratch was observe, the depth of the scratch was measured with a laser microscope.

The abrasion test was performed by pressing a scratch-forming tool, a diamond tip having a tip diameter of 15 μm, onto the liquid-repellent film 3 of the liquid discharge head or the sample for evaluating scratches with a load of 0.098 N (10 gf) and reciprocating the diamond tip ten times. The dynamic contact angle θr for pure water was measured with an automatic contact angle meter (product name: CA-W, manufactured by Kyowa Interface Science Co., Ltd.). The printing property was evaluated using a commercially available ink (trade name: BCI-320 PGBK, manufactured by CANON KABUSHIKI KAISHA) fed in a tank and observing the printing quality. The presence or absence of a scratch was observed by a photograph taken with a Hitachi field emission-scanning electron microscope (product name: S-4300SE/N, manufactured by Hitachi High-Technologies Corporation). The depth of a scratch was measured with a color 3D laser microscope (product name: VD-9710, manufactured by Keyence Corporation).

As shown in Table 6, in the liquid discharge head in Example 1, no scratch was observed after the abrasion test to show satisfactory water repellency and printing property.

Example 2

Resin composition B was prepared as in resin composition A except that polyrotaxane (F) synthesized from the materials shown in Table 5 was used instead of polyurethane (E). A liquid discharge head and a sample for evaluating scratches were produced as in Example 1 except that the resin composition B was used as the material for the self-repairing layer 4 instead of the resin composition A and were evaluated. As shown in Table 6, in the liquid discharge head in Example 2, no scratch was observed after the abrasion test to show satisfactory water repellency and printing property.

Example 3

Resin composition C was prepared as in resin composition A except that polyurethane (G) synthesized from the materials shown in Table 5 was used instead of polyurethane (E). A liquid discharge head and a sample for evaluating scratches were produced as in Example 1 except that the resin composition C was used as the material for the self-repairing layer 4 instead of the resin composition A and were evaluated. As shown in Table 6, in the liquid discharge head in Example 3, although no scratch was observed after the abrasion test to show satisfactory water repellency and printing property, the water repellency was slightly inferior to that of the liquid discharge head in Example 1.

Example 4

Resin composition D was prepared as in resin composition A except that polyurethane (H) synthesized from the materials shown in Table 5 was used instead of polyurethane (E). A liquid discharge head and a sample for evaluating scratches were produced as in Example 1 except that the resin composition D was used as the material for the self-repairing layer 4 instead of the resin composition A and were evaluated. As shown in Table 6, in the liquid discharge head in Example 4, although no scratch was observed after the abrasion test to show satisfactory water repellency and printing property, the water repellency was slightly inferior to that of the liquid discharge head in Example 1.

Example 5

A liquid discharge head and a sample for evaluating scratches were produced as in Example 1 except that the compound (t=5) represented by Formula (7) was used as the material for the liquid-repellent layer 5 instead of the compound (u=30 and v=3) represented by Formula (8) and were evaluated. As shown in Table 6, in the liquid discharge head in Example 5, although no scratch was observed after the abrasion test to show satisfactory water repellency and printing property, the water repellency was slightly inferior to that of the liquid discharge head in Example 1.

Example 6

A liquid discharge head and a sample for evaluating scratches were produced as in Example 1 except that the compound represented by Formula (12) was used as the material for the liquid-repellent layer 5 instead of the compound (u=30 and v=3) represented by Formula (8) and were evaluated.

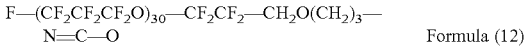

$$F—(CF_2CF_2CF_2O)_{30}—CF_2CF_2—CH_2O(CH_2)_3—N{=}C—O \quad \text{Formula (12)}$$

As shown in Table 6, in the liquid discharge head in Example 6, although no scratch was observed after the abrasion test to show satisfactory water repellency and printing property, the water repellency was slightly inferior to that in Example 1.

Example 7

Production of Liquid Discharge Head

Figure 6A:
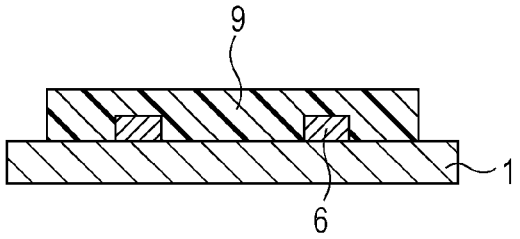
FIGS. 6A to 6E are cross-sectional views illustrating an example of the method of producing a liquid discharge head according to the present invention.
Figure 6B:
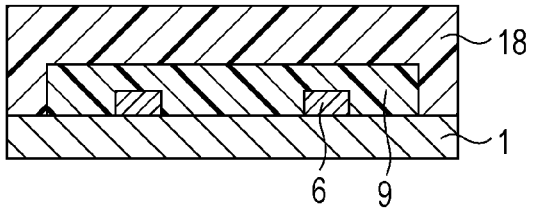

A liquid discharge head was produced by the method shown in FIGS. 6A to 6E. Polymethyl isopropenyl ketone (trade name: ODUR-1010, manufactured by Tokyo Ohka Kogyo Co., Ltd.) was applied at a thickness of 14 μm onto a silicon substrate 1 provided with an energy-generating element 6 and was heated at 120° C. for 6 minutes. Exposure to light in the pattern of a mold material with an exposure apparatus (product name: UX3000, manufactured by Ushio Inc.) and developing with methyl isobutyl ketone (MIBK) were performed to form a mold material 9 (FIG. 6A). The thermosetting resin composition prepared by mixing the materials shown in Table 3 was then applied at a thickness of 25 μm onto the mold material 9 and was heated at 90° C. for 9 minutes to form a coating layer 18 (FIG. 6B).

TABLE 3

| | | |
|---|---|---|
| Epoxy resin | 3,4-epoxycyclohexylmethyl-3,4-epoxycyclohexane carboxylate, manufactured by ADEKA Corp. | 78 parts by mass |
| Thermal polymerization initiator | trade name: Adeka Opton CP-77, manufactured by ADEKA Corp. | 2 parts by mass |

TABLE 3-continued

| | | |
|---|---|---|
| Solvent | butanediol glycidyl ether, manufactured by ADEKA Corp. | 20 parts by mass |

Figure 6C:
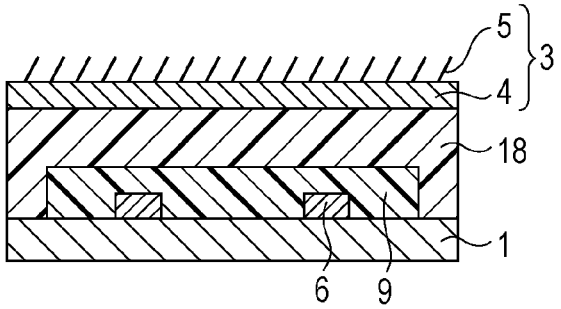

Subsequently, as shown in FIG. 6C, a self-repairing layer 4 and a liquid-repellent layer 5 were formed in this order on the coating layer 18. The self-repairing layer 4 was formed by applying the resin composition A in Example 1 at the thickness shown in Table 6 onto the coating layer 18 and performing heat treatment at 70° C. for 3 minutes. The liquid-repellent layer 5 was formed by applying the material shown in Table 6 at the thickness shown in Table 6 onto the self-repairing layer 4 and performing heat treatment at 70° C. for 3 minutes.

Figure 6D:
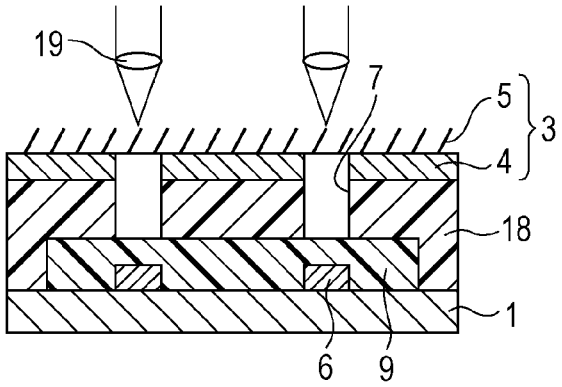
Figure 6E:
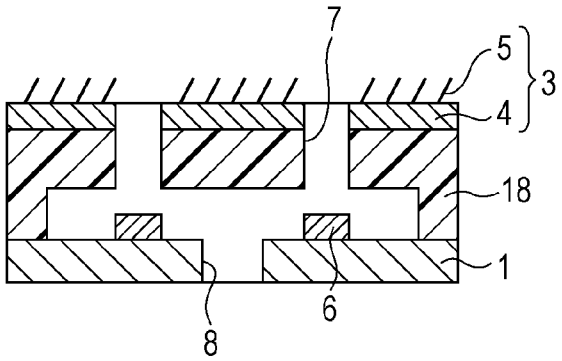

Subsequently, as shown in FIG. 6D, discharge ports 7 were formed by ablating the liquid-repellent film 3 and the coating layer 18 with short-pulse laser light condensed with a lens 19. Hyper Rapid (product name, manufactured by LUMERA LASER GmbH) was used as a short-pulse oscillator for irradiating the short-pulse laser light for laser oscillation under the condition shown in Table 4. Then, a liquid discharge head was produced as in Example 1.

TABLE 4

| | |
|---|---|
| Laser wavelength | 355 nm |
| Condensed light spot diameter | 2.0 μm |
| Irradiation fluence | 1.274 J/cm$^2$ |

(Production of Sample for Evaluating Scratches)

Figure 7A:
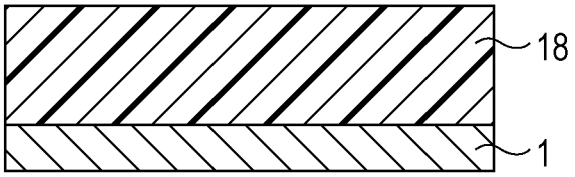
FIGS. 7A and 7B are cross-sectional views illustrating a method of producing a sample for evaluating scratches according to the present invention.

As shown in FIG. 7A, a thermosetting resin composition prepared by mixing the materials shown in Table 3 was applied at a thickness of 25 μm onto a silicon substrate 1 and was heated at 90° C. for 9 minutes to form a coating layer 18.

Figure 7B:
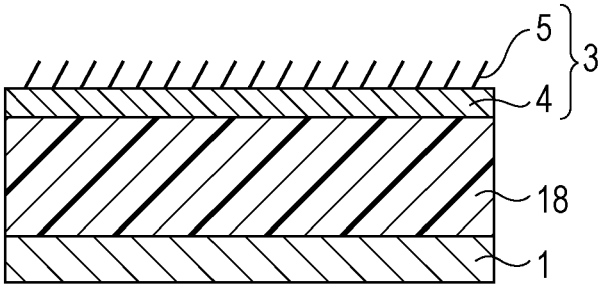

Subsequently, as shown in FIG. 7B, a self-repairing layer 4 and a liquid-repellent layer 5 were formed in this order on the coating layer 18. The self-repairing layer 4 was formed by applying the resin composition A in Example 1 at the thickness shown in Table 6 onto the coating layer 18 and performing heat treatment at 70° C. for 3 minutes. The liquid-repellent layer 5 was formed by applying the material shown in Table 6 at the thickness shown in Table 6 onto the self-repairing layer 4 and performing heat treatment at 70° C. for 3 minutes. Then, the coating layer 18 and the liquid-repellent film 3 were completely cured by heat treatment at 200° C. for 1 hour to produce a sample for evaluating scratches.

(Evaluation)

The liquid discharge head and the sample for evaluating scratches were evaluated as in Example 1. As shown in Table 6, in the liquid discharge head in Example 7, no scratch was observed after the abrasion test to show satisfactory water repellency and printing property.

Example 8

Resin composition E was prepared as in resin composition A except that polyrotaxane (I) synthesized from the materials shown in Table 5 was used instead of polyurethane (E). A liquid discharge head and a sample for evaluating scratches were produced as in Example 1 except that the resin composition E was used as the material for the self-repairing layer 4 instead of the resin composition A and were evaluated. As shown in Table 6, in the liquid discharge head in Example 8, no scratch was observed after the abrasion test to show satisfactory water repellency and printing property.

Example 9

A liquid discharge head and a sample for evaluating scratches were produced as in Example 1 except that the thickness of the liquid-repellent layer 5 was changed from 4 nm to 8 nm and were evaluated. As shown in Table 6, in the liquid discharge head in Example 9, no scratch was observed after the abrasion test to show satisfactory water repellency and printing property.

Comparative Example 1

A liquid discharge head and a sample for evaluating scratches were produced as in Example 1 except that the thickness of the liquid-repellent layer 5 was changed from 4 nm to 0.5 μm and were evaluated. As shown in Table 6, in the liquid discharge head in Comparative Example 1, scratches were observed after the abrasion test. In the evaluation of the printing property, a large number of printing wrinkles were generated, and the image quality was significantly low.

Comparative Example 2

A liquid discharge head and a sample for evaluating scratches were produced as in Example 1 except that the self-repairing layer 4 was not provided and were evaluated. As shown in Table 6, in the liquid discharge head in Comparative Example 2, scratches were observed after the abrasion test to reduce the water repellency. In the evaluation of the printing property, a large number of printing wrinkles were generated, and the image quality was significantly low.

TABLE 5

| | Mixture | | | | |
|---|---|---|---|---|---|
| Raw material | Examples 1, 5 to 7 and Comparative Examples 1 polyurethane (E) | Example 2 polyrotaxane (F) | Example 3 polyurethane (G) | Example 4 polyurethane (H) | Example 8 polyrotaxane (I) |
| hexamethylene diisocyanate (special grade chemical) | 10 parts by mass | — | 10 parts by mass | 10 parts by mass | — |
| polyester polyol Polylite OD-X-286 (trade name, manufactured by DIC Corp.) | 80 parts by mass | — | 60 parts by mass | 80 parts by mass | — |
| 1,2,4-butane triol (manufactured by Tokyo Chemical Industry Co., Ltd.) | 10 parts by mass | — | 10 parts by mass | — | — |
| polyethylene glycol PEG 6000 (special grade chemical) | — | 10 parts by mass | — | — | 10 parts by mass |
| α-cyclodextrin (special grade chemical) | — | 12 parts by mass | — | — | 12 parts by mass |
| trimethylsilyl triethyl ether (special grade chemical) | — | 0.5 parts by mass | — | — | — |
| 1-adamantanamine hydrochloride (manufactured by Junsei Chemical Co., Ltd) | — | — | — | — | 0.5 parts by mass |

TABLE 6

| | | Example 1 | Example 2 | Example 3 | Example 4 | Example 5 | Example 6 |
|---|---|---|---|---|---|---|---|
| Self-repairing layer | material | resin composition A | resin composition B | resin composition C | resin composition D | resin composition A | resin composition A |
| | thickness | 5 μm | 5 μm | 5 μm | 5 μm | 5 μm | 5 μm |
| Liquid-repellent layer | material | Formula (8) u = 30, v = 3 | Formula (8) u = 30, v = 3 | Formula (8) u = 30, v = 3 | Formula (8) u = 30, v = 3 | Formula (7) t = 5 | Formula (12) |
| | thickness | 4 nm | 4 nm | 4 nm | 4 nm | 4 nm | 4 nm |
| Presence of scratch | | No | No | No | No | No | No |
| Depth of scratch | | — | — | — | — | — | — |
| Dynamic contact angle θr for pure water | | 95° | 95° | 90° | 90° | 85° | 85° |
| Printing property | | Good | Good | Good | Good | Good | Good |

| | | Example 7 | Example 8 | Example 9 | Comparative Example 1 | Comparative Example 2 |
|---|---|---|---|---|---|---|
| Self-repairing layer | material | resin composition A | resin composition E | resin composition A | resin composition A | — |
| | thickness | 5 μm | 5 μm | 5 μm | 5 μm | — |
| Liquid-repellent layer | material | Formula (8) u = 30, v = 3 | Formula (8) u = 30, v = 3 | Formula (8) u = 30, v = 3 | Formula (8) u = 30, v = 3 | Formula (8) u = 30, v = 3 |
| | thickness | 4 nm | 4 nm | 8 nm | 0.5 μm | 4 nm |
| Presence of scratch | | No | No | No | Yes | Yes |
| Depth of scratch | | — | — | — | 0.5 μm | 20 μm |
| Dynamic contact angle θr for pure water | | 95° | 95° | 95° | 95° | 60° |
| Printing property | | Good | Good | Good | a lot of printing wrinkles | a lot of printing wrinkles |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-183897, filed Sep. 5, 2013, which is hereby incorporated by reference herein in its entirety.

What is claimed is:

1. A liquid discharge head comprising:

a discharge port-forming member having discharge ports for discharging a liquid and having a surface provided with a liquid-repellent film, wherein the liquid-repellent film includes a resin composition-containing layer containing a resin composition containing at least one of polyurethane and polyrotaxane disposed on the discharge port-forming member and a layer containing a fluorine compound and having a thickness of 10 nm or less disposed on the resin composition-containing layer, wherein when a scratch-forming tool, a diamond tip having a tip diameter of 15 μm, is pressed onto the liquid-repellent film with a load of 0.098 N (10 gf) and is reciprocated ten times, the depth of a scratch formed on the surface of the liquid-repellent film is smaller than the thickness of the fluorine compound-containing layer.

2. The liquid discharge head according to claim 1, wherein the polyurethane is prepared by reacting one equivalent of a diisocyanate compound with a raw material containing more than one equivalent of a di- or higher valent polyol.

3. The liquid discharge head according to claim 2, wherein the raw material further contains a short chain diol or a tri- or higher valent short chain polyol.

4. The liquid discharge head according to claim 1, wherein the polyrotaxane includes a circular molecule, a linear molecule passing through the circular molecule in a skewered state, and blocking groups disposed at both ends of the linear molecule for preventing detachment of the circular molecule, wherein the circular molecule is cyclodextrin; and the linear molecule is polyethylene glycol.

5. The liquid discharge head according to claim 1, wherein the resin composition contains a photo-curable resin.

6. The liquid discharge head according to claim 5, wherein the photo-curable resin is a photocationic-curable resin.

7. The liquid discharge head according to claim 6, wherein the photo-curable resin is an epoxy resin.

8. The liquid discharge head according to claim 7, wherein the epoxy resin has an epoxy equivalent of 2000 or less.

9. The liquid discharge head according to claim 7, wherein the epoxy resin has an epoxy equivalent of 1000 or less.

10. The liquid discharge head according to claim 7, wherein the epoxy resin is in a solid form in a temperature range of 20° C.±15° C.

11. The liquid discharge head according to claim 6, wherein the resin composition contains a photocationic polymerization initiator.

12. The liquid discharge head according to claim 11, wherein the photocationic polymerization initiator is at least either an aromatic iodonium salt or an aromatic sulfonium salt.

13. The liquid discharge head according to claim 1, wherein the fluorine compound includes a perfluoropolyether group.

14. The liquid discharge head according to claim 13, wherein the perfluoropolyether group moiety of the fluorine compound has an average molecular weight of 500 to 20000.

15. The liquid discharge head according to claim 1, wherein the fluorine compound includes a reactive silane group.

16. The liquid discharge head according to claim 1, wherein the fluorine compound is at least one compound represented by any of Formulae (3) to (6):

$$\text{F-Rp-X—SiR}_a\text{Y}_{3-a} \qquad \text{Formula (3)}$$

wherein, Rp represents a perfluoropolyether group; X represents a divalent organic group; R represents a hydrolytic substituent; Y represents a non-hydrolytic substituent; and a represents an integer of 1 to 3, $$\text{Y}_{3-a}\text{R}_a\text{Si-A-Rp-A-SiR}_a\text{Y}_{3-a} \qquad \text{Formula (4)}$$

wherein, A represents an organic group having 1 to 12 carbon atoms; and Rp, R, Y, and a are synonymous with those in Formula (3), $$\text{F—Rp—Q}^1\text{—}(\underset{\underset{\text{SiR}_a\text{Y}_{3-a}}{|}}{\text{A}})_m\text{—Z} \qquad \text{Formula (5)}$$

wherein, Z represents a hydrogen atom or an alkyl group; $Q^1$ represents a divalent bonding group; m represents an integer of 1 or more; Rp, R, Y, and a are synonymous with those in Formula (3); and A is synonymous with that in Formula (4), and $$\text{F—Rp—Q}^2\text{—}(\text{A—SiR}_a\text{Y}_{3-a})_n \qquad \text{Formula (6)}$$

wherein, n represents an integer of 1 or 2; $Q^2$ represents a divalent bonding group when n is 1 and represents a trivalent bonding group when n is 2; Rp, R, Y, and a are synonymous with those in Formula (3); and A is synonymous with that in Formula (4).

* * * * *